US010612507B2

(12) United States Patent
Oh et al.

(10) Patent No.: US 10,612,507 B2
(45) Date of Patent: Apr. 7, 2020

(54) MOUNTING STRUCTURE OF FUEL RAIL

(71) Applicant: HYUNDAI KEFICO CORPORATION, Gunpo, Gyeonggi-do (KR)

(72) Inventors: Seung Hyuk Oh, Gyeonggi-do (KR); Young Il Kang, Gyeonggi-do (KR); Kwang Won Koo, Seoul (KR); Myeong Hun Kweon, Gyeonggi-do (KR); Yeon Jee Oh, Seoul (KR)

(73) Assignee: HYUNDAI KEFICO CORPORATION, Gunpo-Si, Gyeonggi-Do (KR)

( * ) Notice: Subject to any disclaimer, the term of this patent is extended or adjusted under 35 U.S.C. 154(b) by 0 days.

(21) Appl. No.: 15/952,395

(22) Filed: Apr. 13, 2018

(65) Prior Publication Data

US 2018/0230954 A1 Aug. 16, 2018

Related U.S. Application Data

(63) Continuation of application No. PCT/KR2017/011668, filed on Oct. 20, 2017.

(30) Foreign Application Priority Data

Oct. 21, 2016 (KR) ..... 10-2016-0137559

(51) Int. Cl.
*F02M 55/02* (2006.01)
*F02M 61/14* (2006.01)
*F02M 55/04* (2006.01)

(52) U.S. Cl.
CPC ..... *F02M 55/025* (2013.01); *F02M 55/04* (2013.01); *F02M 61/14* (2013.01);
(Continued)

(58) Field of Classification Search
CPC ..... F02M 55/025; F02M 55/04; F02M 61/14; F02M 2200/8084; F02M 2200/03;
(Continued)

(56) References Cited

U.S. PATENT DOCUMENTS 5,803,168 A * 9/1998 Lormand ..... E21B 19/22 166/77.2
6,640,784 B1 * 11/2003 Sims, Jr. ..... F02M 55/025 123/456
(Continued)

FOREIGN PATENT DOCUMENTS

DE 10-2005-012941 A1 9/2006
EP 3244056 A1 * 11/2017 ..... F02M 55/025
(Continued)

OTHER PUBLICATIONS

The China National Intellectual Property Administration (CNIPA) First Office Action issued in corresponding CN Application No. 2017800031389, dated Aug. 27, 2019 (Aug. 27, 2019). 7 pages.

*Primary Examiner* — Phutthiwat Wongwian
*Assistant Examiner* — Susan E Scharpf
(74) *Attorney, Agent, or Firm* — Mintz Levin Cohn Ferris Glovsky and Popeo, P.C.; Peter F. Corless

(57) ABSTRACT

Disclosed herein is a mounting structure of a fuel rail, including a mounting boss part having a through-hole formed in a longitudinal direction and a first mating surface formed at an outer surface, an injector cup part provided separately from the mounting boss part and having a second mating surface formed at an outer surface and a flow path hole formed at one side of the second mating surface to be connected to the main pipe for transferring fuel to an injector, and a bridge part connecting the mounting boss part and the injector cup part and having a third mating surface. The mounting structure of the fuel rail can effectively
(Continued)

distribute stress concentration by increasing contact area with the main pipe, thereby improving fatigue strength.

6 Claims, 12 Drawing Sheets

(52) U.S. Cl.
CPC ..... *F02M 2200/02* (2013.01); *F02M 2200/03* (2013.01); *F02M 2200/8084* (2013.01); *F02M 2200/856* (2013.01); *F02M 2200/857* (2013.01)

(58) Field of Classification Search
CPC ..... F02M 2200/857; F02M 2200/856; F02M 2200/02; F02M 55/02; F02M 2200/85; F02M 2200/855
USPC ..... 123/469
See application file for complete search history.

(56) References Cited

U.S. PATENT DOCUMENTS

| | | | | |
|---|---|---|---|---|
| 9,863,387 | B2 * | 1/2018 | Wiedmann | F02M 55/025 |
| 2007/0169751 | A1 * | 7/2007 | Tominaga | F02M 55/025 123/456 |
| 2010/0071664 | A1 * | 3/2010 | Hunt | F02M 55/025 123/456 |
| 2010/0300409 | A1 * | 12/2010 | Harvey | F02M 61/14 123/470 |
| 2012/0280067 | A1 * | 11/2012 | Serra | F02M 55/025 239/533.2 |
| 2013/0074805 | A1 * | 3/2013 | Yamamoto | F02M 51/06 123/456 |
| 2014/0261332 | A1 * | 9/2014 | Ramamurthy | F02M 61/14 123/470 |
| 2015/0075496 | A1 * | 3/2015 | Pasquali | F02M 61/14 123/469 |
| 2016/0319787 | A1 * | 11/2016 | Udagawa | F02M 55/004 |
| 2017/0022951 | A1 * | 1/2017 | Serra | F02M 55/005 |
| 2017/0248108 | A1 * | 8/2017 | Di Domizio | F02M 55/005 |
| 2017/0328321 | A1 * | 11/2017 | Serra | F02M 55/025 |

FOREIGN PATENT DOCUMENTS

| | | | | |
|---|---|---|---|---|
| JP | 2001-050134 | A | 2/2001 | |
| JP | 2010-077959 | A | 4/2010 | |
| JP | 2013-177854 | A | 9/2013 | |
| KR | 10-2011-0016140 | A | 2/2011 | |
| KR | 10-2015-0048548 | A | 5/2015 | |
| KR | 10-2015-0053925 | A | 5/2015 | |
| WO | WO2015093163 | A1 * | 6/2015 | F02M 55/02 |

* cited by examiner

MOUNTING STRUCTURE OF FUEL RAIL

CROSS-REFERENCE TO RELATED APPLICATION

This application is a continuation of International Application No. PCT/KR2017/011668 filed on Oct. 20, 2017, which claims priority to Korean Patent Application No. 10-2016-0137559 filed on Oct. 21, 2016, which application are incorporated herein by reference.

TECHNICAL FIELD

The present disclosure relates to a mounting structure of a fuel rail, and more particularly, to a mounting structure of a fuel rail, which is capable of effectively distributing stress concentration through an increase in contact area with a main pipe.

RELATED ART

In general, a gasoline direction injection (GDI) engine refers to an engine which increases combustion efficiency by directly injecting high-pressure gasoline fuel into a combustion chamber, thereby reducing exhaust gas while improving fuel efficiency and power.

On the other hand, an existing multi-point injection (MPI) or port fuel injection (PFI) engine injects fuel into an intake port and intake valve, and then supplies a gas mixture into a combustion chamber. Therefore, when a fuel rail is developed, the design has been focused on ensuring reliability for vibration or fuel pulsation in a fuel rail rather than ensuring rigidity against fuel pressure. However, the GDI engine must preferentially ensure fatigue strength against heat, pressure or vibration generated from the engine in consideration of a fuel rail filled with high-pressure gasoline fuel.

In this connection, Korean Patent Registration No. 10-1027791B1 (Patent Document 1) has disclosed a mounting structure of a fuel rail for GDI engine, which has been submitted as the related art by the present applicant.

Patent Document 1 discloses a mounting structure of a direct injection fuel rail, including an injector cup and a mount structure which are coupled to a main pipe. The injector cup and the mount structure are connected and integrated with each other through a bridge, the injector cup is mated to the main pipe, and the mount structure and the main pipe are separated from each other.

However, the structure disclosed in Patent Document 1 may not provide fatigue strength capable of withstanding an internal pressure (250 bar or more) of the fuel rail for GDI engine, even though the standards for the fatigue strength have recently become stricter in terms of environment regulations.

Furthermore, Patent Document 1 does not disclose a damping structure for absorbing fatigue stress due to heat, pressure and vibration generated from the engine.

SUMMARY

The present disclosure has been made in view of the above problems, and it is an object of the present disclosure to provide a mounting structure of a fuel rail, which is capable of effectively distributing stress concentration through an increase in contact area with a main pipe, thereby improving fatigue strength.

It is another object of the present disclosure to provide a mounting structure of a fuel rail, which includes a damping structure for effectively absorbing fatigue stress due to heat, pressure and vibration generated from an engine.

In accordance with one aspect of the present disclosure, a mounting structure of a fuel rail may include a mounting boss part having a through-hole formed in a longitudinal direction thereof such that a fixing member fastened to a boss part formed on a cylinder head at an engine is inserted through the through-hole, and a first mating surface formed at an outer surface thereof and attached and mated to one side surface of a main pipe, an injector cup part provided separately from the mounting boss part, and having a second mating surface formed at an outer surface thereof and attached and mated to the other side surface of the main pipe, and a flow path hole formed at one side of the second mating surface and connected to the main pipe so as to transfer fuel to an injector, and a bridge part connecting the mounting boss part and the injector cup part, and having a third mating surface attached and mated to the bottom surface of the main pipe.

The mounting boss part may have one or more first damping slits formed at the circumference thereof to absorb fatigue stress due to heat, pressure and vibration generated from the engine. The first damping slit of the mounting boss part may be formed in a hole shape connected to the through-hole. The bridge part may have one or more second damping slits formed at the circumference thereof to absorb fatigue stress due to heat, pressure and vibration generated from the engine. The second damping slit of the bridge part may be formed in a hole shape across the bridge part under the third mating surface.

In addition, the first mating surface of the mounting boss part, the second mating surface of the injector cup part and the third mating surface of the bridge part may be configured in such a manner that a contact center line in a direction crossing the main pipe intersects the axial center of the main pipe at a right angle, the contact center line being formed when the main pipe is clamped by the first mating surface of the mounting boss part, the second mating surface of the injector cup and the third mating surface of the bridge part.

Further, the mounting boss part and the bridge part may be integrally formed as one body. The bridge part and the injector cup part may be coupled to each other through welding or brazing.

According to the embodiment of the present disclosure, the mounting structure of the fuel rail can effectively distribute stress concentration through the increase in contact area with the main pipe, thereby improving the fatigue strength.

Furthermore, the mounting structure of the fuel rail has the damping structure for effectively absorbing the fatigue stress due to heat, pressure and vibration generated from the engine.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
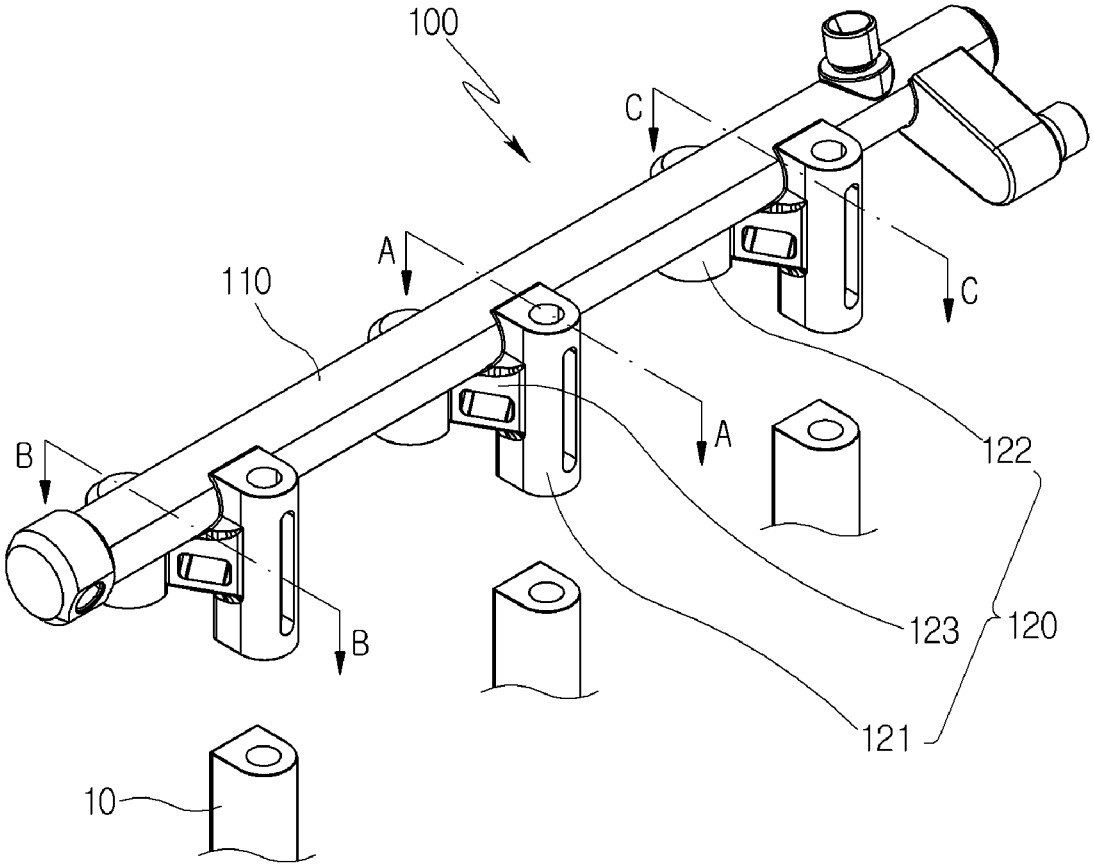
FIG. 1 is a perspective view of a fuel rail to which a mounting structure according to a first exemplary embodiment of the present disclosure is applied.

The drawings are not necessarily to scale and in some instances, proportions may have been exaggerated in order to clearly illustrate features of the present disclosure. Furthermore, terms described later are defined in consideration of functions in the present disclosure, and may be changed depending on the custom or intention of a user or operator. Therefore, the definitions of the terms should be based on the overall contents of this specification. The embodiments are only examples of components described in the claims of the present disclosure, and do not limit the scope of the present disclosure. The claims should be analyzed based on the technical idea of the present disclosure.

In some embodiments, well-known process steps, well-known structures and well-known techniques will not be specifically described in order to avoid ambiguous interpretation of the present disclosure. The terms used in the present specification are for the purpose of illustrating the examples and do not limit the present disclosure. As used herein, the singular form also includes the plural forms unless specifically stated in a phrase. The terns "comprises" and/or "comprising" used in the specification are used in the meaning of not excluding the presence or addition of one or more other constituent elements, steps, operations and/or elements, in addition to the referenced constituent elements, step, operation and/or element. Further, the term "and/or" includes each and one or more combinations of the referenced items. The same reference numerals refer to the same components throughout the disclosure.

First Embodiment

Figure 2:
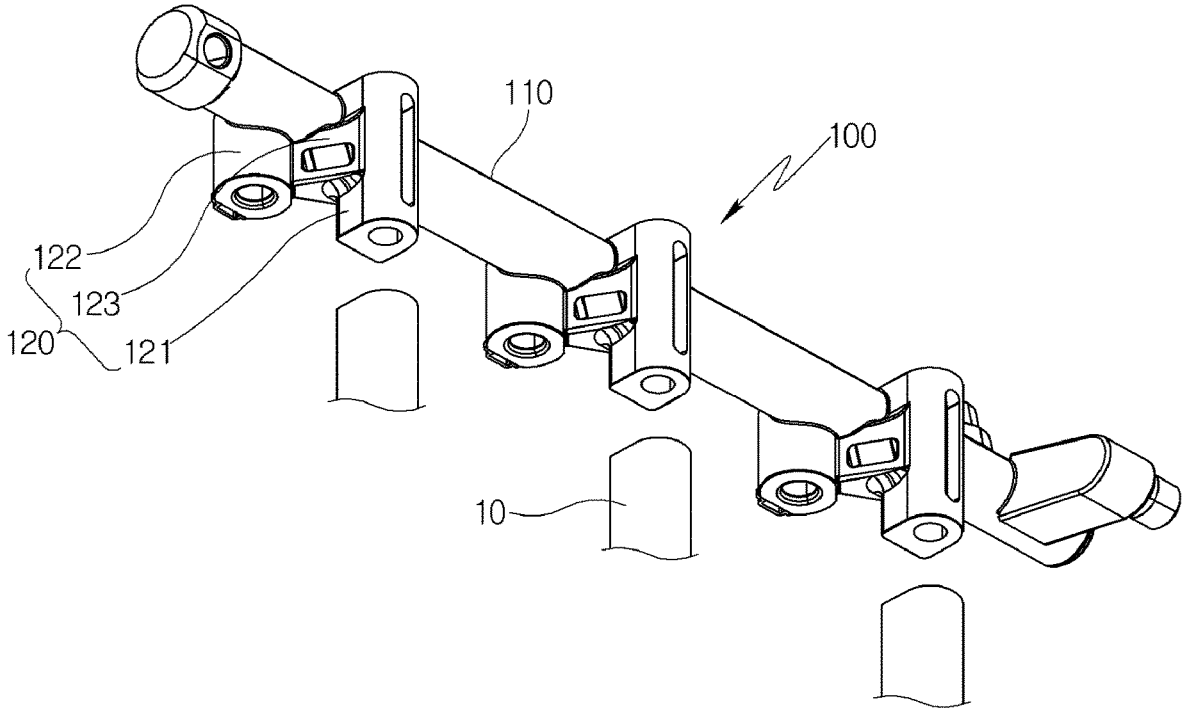
FIG. 2 is a perspective view of the fuel rail of FIG. 1, seen from a different angle.
Figure 3:
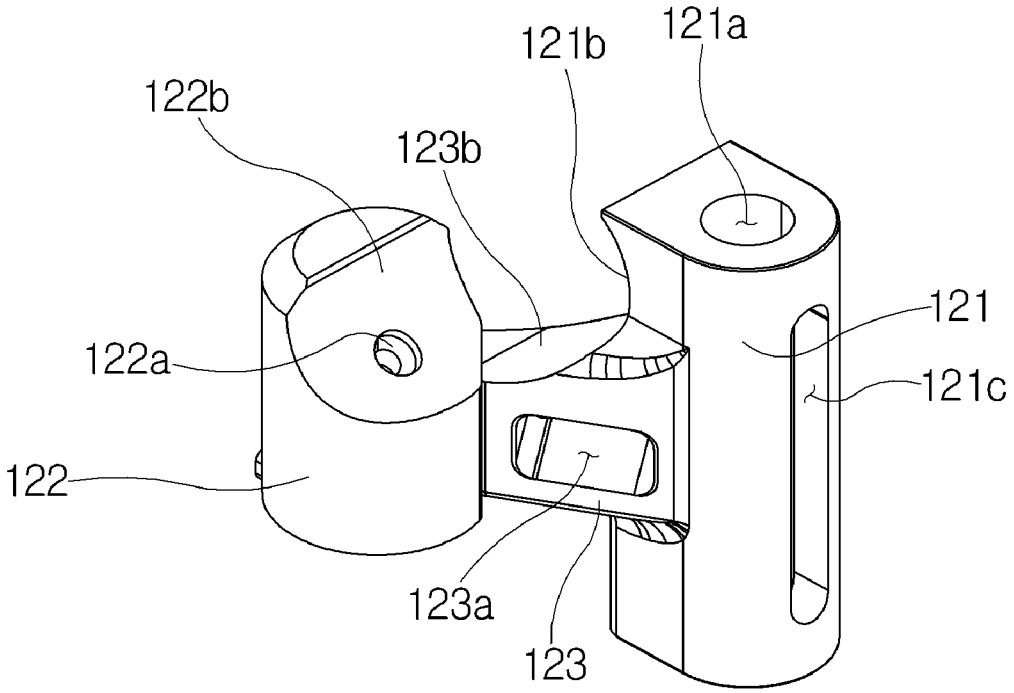
FIG. 3 is a perspective view of the mounting structure of the fuel rail illustrated in FIG. 1.
Figure 4:
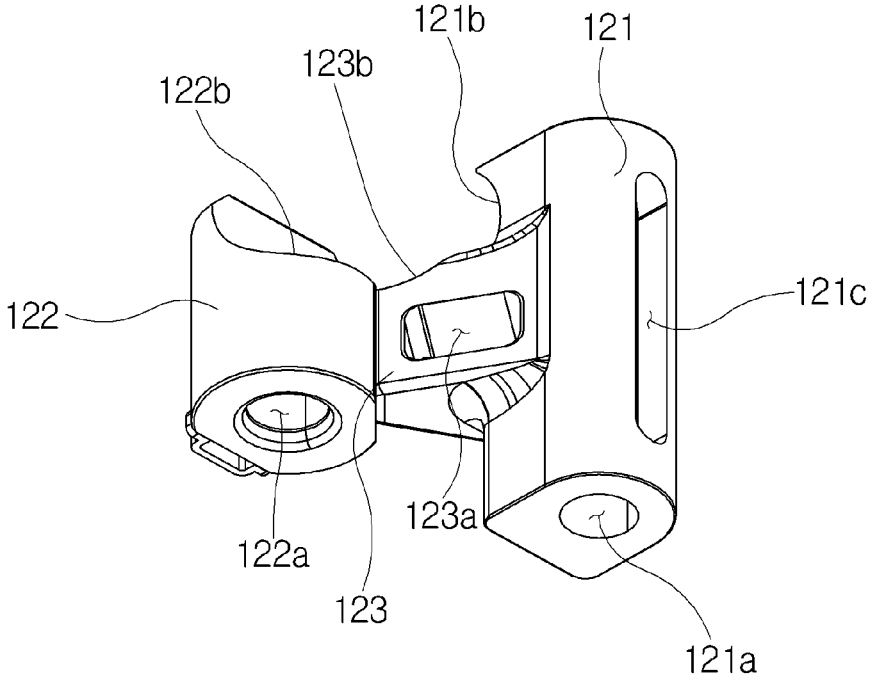
FIG. 4 is a perspective view of the mounting structure of the fuel rail of FIG. 3, seen from a different angle.
Figure 5:
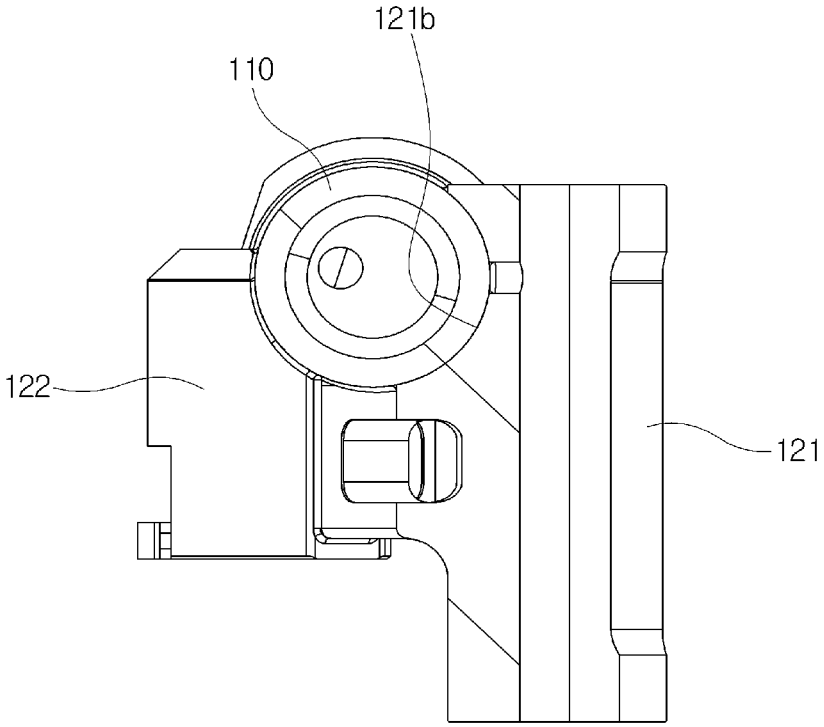
FIG. 5 is a cross-sectional view taken along the line A-A of FIG. 1.
Figure 6:
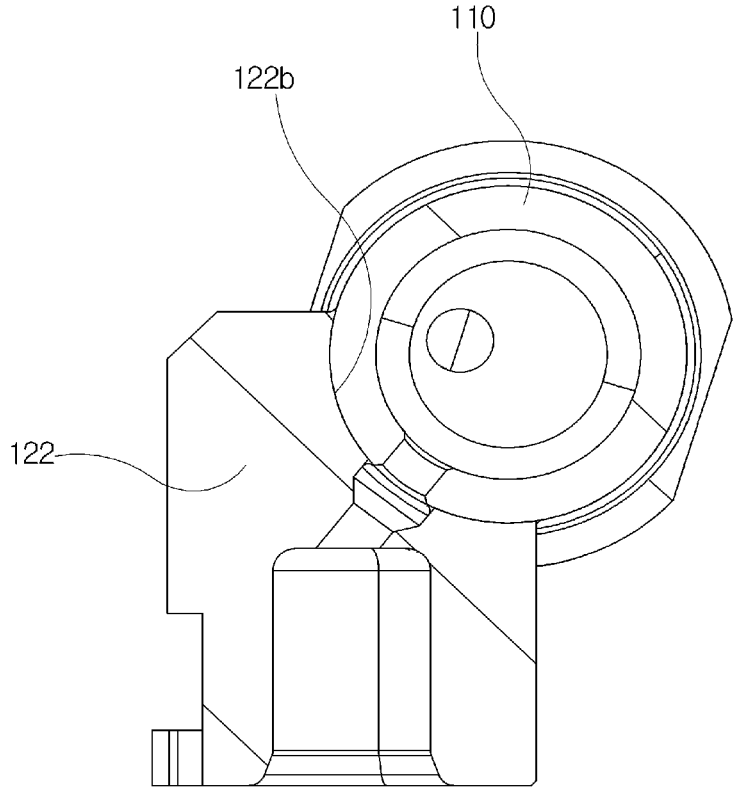
FIG. 6 is a cross-sectional view taken along the line B-B of FIG. 1.
Figure 7:
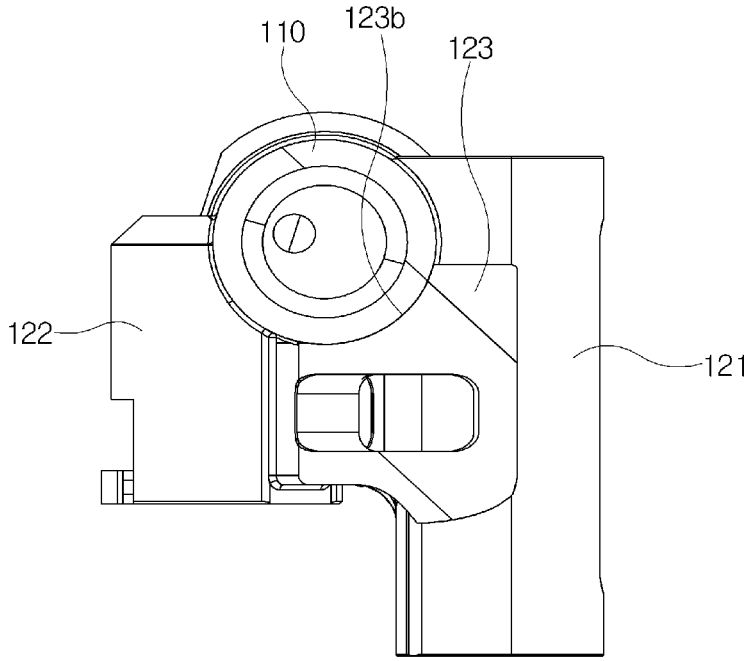
FIG. 7 is a cross-sectional view taken along the line C-C of FIG. 1.

FIG. 1 is a perspective view of a fuel rail to which a mounting structure according to a first exemplary embodiment of the present disclosure is applied, FIG. 2 is a perspective view of the fuel rail of FIG. 1, seen from a different angle, FIG. 3 is a perspective view of the mounting structure of the fuel rail illustrated in FIG. 1, FIG. 4 is a perspective view of the mounting structure of the fuel rail of FIG. 3, seen from a different angle, FIG. 5 is a cross-sectional view taken along the line A-A of FIG. 1, FIG. 6 is a cross-sectional view taken along the line B-B of FIG. 1, and FIG. 7 is a cross-sectional view taken along the line C-C of FIG. 1.

Referring to FIGS. 1 to 7, the mounting structure 120 of the fuel rail 100 according to the first exemplary embodiment of the present disclosure may include a mounting boss part 121, an injector cup part 122 and a bridge part 123.

The mounting boss part 121 may be a cylindrical member and have a through-hole 121*a* and a first mating surface 121*b*. The through-hole 121*a* may be formed in the longitudinal direction of the mounting boss part 121 such that a fastening member such as a bolt may be inserted into the through-hole 121*a*, the fastening member being fastened to a boss part 10 formed on a cylinder head at an engine. The first mating surface 121*b* may be formed at the outer surface of the mounting boss part 121 and attached and mated to one side surface of the main pipe 110.

Unlike Patent Document 1, the first mating surface 121*b* of the mounting boss part 121 may form a structure of clamping the bottom surface and both side surfaces of the main pipe 110, with a second mating surface 122*b* of the injector cup part 122 and a third mating surface 123*b* of the bridge part 123, which are described later. Thus, the structure increases a contact area with the main pipe 110 in a direction crossing the axial center of the main pipe 110 (refer to symbol g in FIG. 8), thereby effectively distributing stress concentration.

In this case, as illustrated in FIG. 5, the first mating surface 121*b* of the mounting boss part 121 may be attached to one surface of the main pipe 110 and mated through welding or brazing.

The mounting boss part 121 may have one or more first damping slits 121*c* formed at the circumference thereof, the one or more first damping slits 121*c* serving to absorb fatigue stress due to heat, pressure and vibration generated from the engine. When the fuel rail 100 is displaced by heat, pressure and vibration generated from the engine, the first damping slit 121*c* may provide a space for exerting an elastic force which absorbs fatigue stress while elastically deforming the mounting boss part 121, and then may return the mounting boss part 121 to the original shape when the displacement is removed.

In particular, the damping slit 121*c* of the mounting boss part 121 may be formed in the shape of a hole communicating with the through-hole 121*a*.

The injector cup part 122 may be a cylindrical member, and serve to form a space in which an injector (not illustrated) is installed, and transfer fuel from the main pipe 110 to the injector.

The injector cup part 122 may be separated from the mounting boss part 121 and have a second mating surface 122*b* and a flow path hole 122*a*. The second mating surface 122*b* may be formed at the outer surface of the injector cup part 122, and attached and mated to the other side surface of the main pipe 110. The flow path hole 122*a* may be formed at one side of the second mating surface 122*b*, and connected to the main pipe 110 so as to transfer fuel to the injector.

The second mating surface 122*b* of the injector cup part 122 may form a structure of clamping the bottom surface and both side surfaces of the main pipe 110 with the first mating surface 121*b* of the mounting boss part 121 and the third mating surface 123*b* of the bridge part 123. Thus, the structure may increase a contact area with the main pipe 110 in a direction crossing the axial center of the main pipe 110 (refer to symbol g in FIG. 8), thereby effectively distributing stress concentration.

In this case, as illustrated in FIG. 6, the second mating surface 122*b* of the injector cup part 122 may be attached to the other side surface of the main pipe 110 and mated through welding or brazing.

The injector cup part 122 may have one or more damping slits (not illustrated) formed at the circumference thereof, the damping slits serving to absorb fatigue stress due to heat, pressure and vibration generated from the engine, like the first damping slit 121*c* of the mounting boss part 121 and a second damping slit 123*a* of the bridge part 123. However, the injector cup part 122 may not have separate damping slits (not illustrated), in order to not only reliably install the injector, but also increase stiffness.

The bridge part 123 may connect the mounting boss part 121 and the injector cup part 122.

The bridge part 123 may have the third mating surface 123*c* which is attached and mated to the bottom surface of the main pipe 110.

The third mating surface 123*b* of the bridge part 123 may form a structure of clamping the bottom surface and both side surfaces of the main pipe 110 with the first mating surface 121*b* of the mounting boss part 121 and the second mating surface 122*b* of the injector cup part 122. Thus, the structure may increase a contact area with the main pipe 110 in a direction crossing the axial center of the main pipe 110 (refer to symbol g in FIG. 8), thereby effectively distributing stress concentration.

In this case, as illustrated in FIG. 7, the third mating surface 123*b* of the bridge part 123 may be attached to the bottom surface of the main pipe 110 and mated through welding or brazing.

The bridge part 123 may have one or more second damping slits 123*a* formed at the circumference thereof, the second damping slits 123*a* serving to absorb fatigue stress due to heat, pressure and vibration generated from the engine. When the fuel rail 100 is displaced by the heat, pressure and vibration generated from the engine, the second damping slit 123*a* may provide a space for exerting an elastic force which absorbs fatigue stress while elastically deforming the bridge part 123, and then may return the bridge part 123 to the original shape when the displacement is removed.

In particular, the second damping slit 123*a* of the bridge part 123 may be formed in a hole shape crossing the body under the third mating surface 123*b*.

The mounting boss part 121 and the bridge part 123 may be formed as one body (e.g., integrally formed). This is because, when the mounting boss part 121 and the bridge part 123 are formed as one body, stiffness can be increased more effectively than when the mounting boss part 121 and the bridge part 123 are separately manufactured and then connected (e.g., coupled) through welding or brazing. The mounting boss part 121 and the bridge part 123 may be separately manufactured.

At this time, when the mounting boss part 121 and the bridge part 123 are formed as one body, the bridge part 123 and the injector cup part 122 may be mated and connected to each other through welding or brazing. The mounting boss part 121, the injector cup part 122 and the bridge part 123 may be manufactured as one body. In general, however, the injector cup part 122 may be separately manufactured depending on the specification of the injector, in order to improve the manufacturing efficiency.

Second Embodiment

Figure 8:
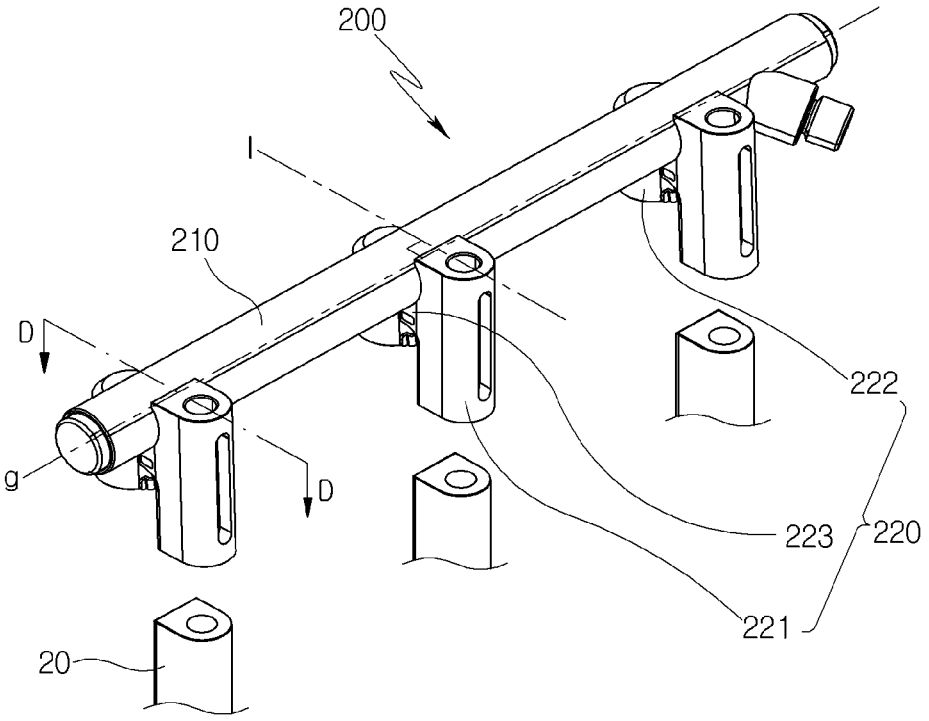
FIG. 8 is a perspective view of a fuel rail to which a mounting structure according to a second exemplary embodiment of the present disclosure is applied.
Figure 9:
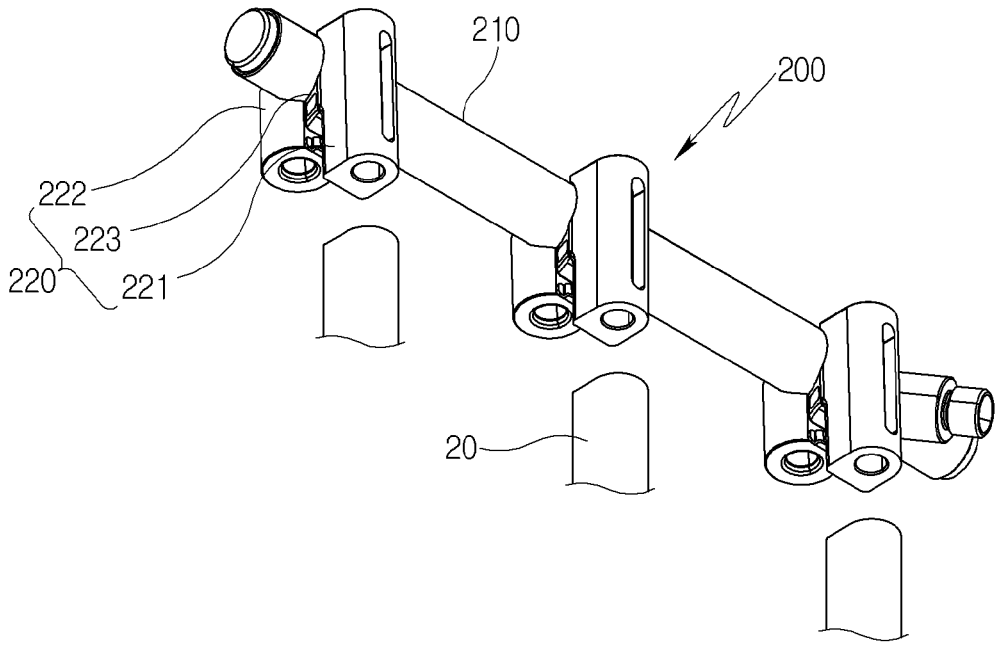
FIG. 9 is a perspective view of the fuel rail of FIG. 8, seen from a different angle.
Figure 10:
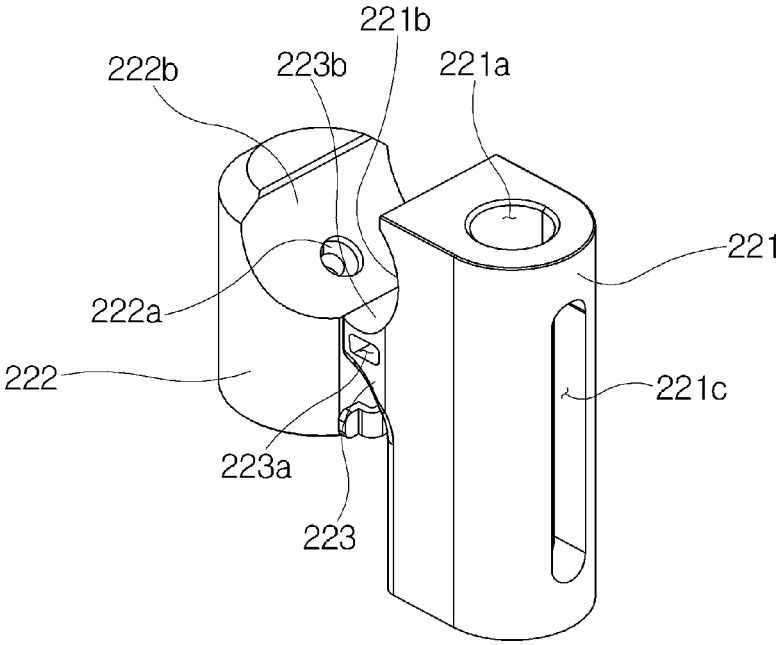
FIG. 10 is a perspective view of the mounting structure of the fuel rail illustrated in FIG. 8.
Figure 11:
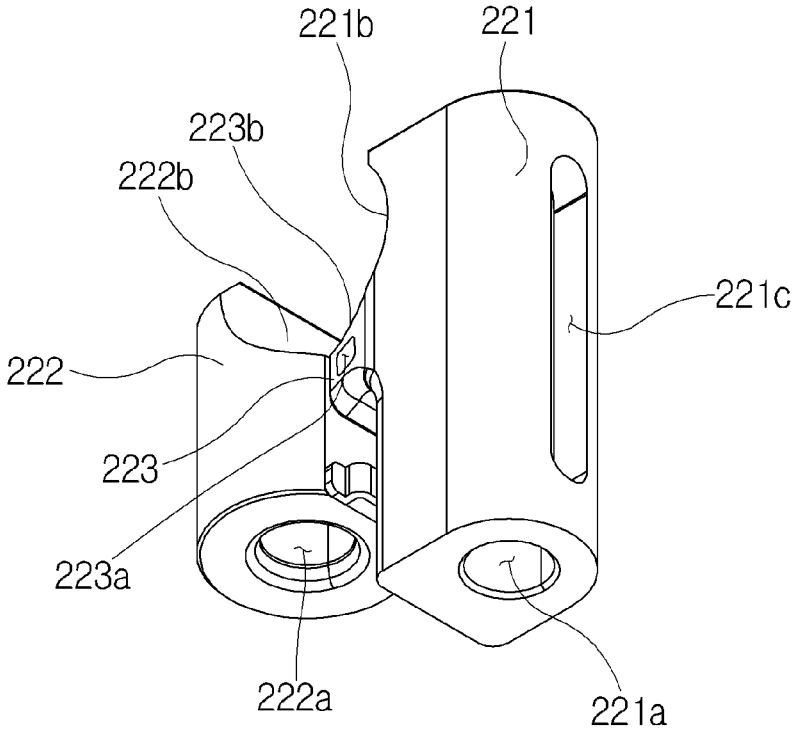
FIG. 11 is a perspective view of the mounting structure of the fuel rail of FIG. 10, seen from a different angle.
Figure 12:
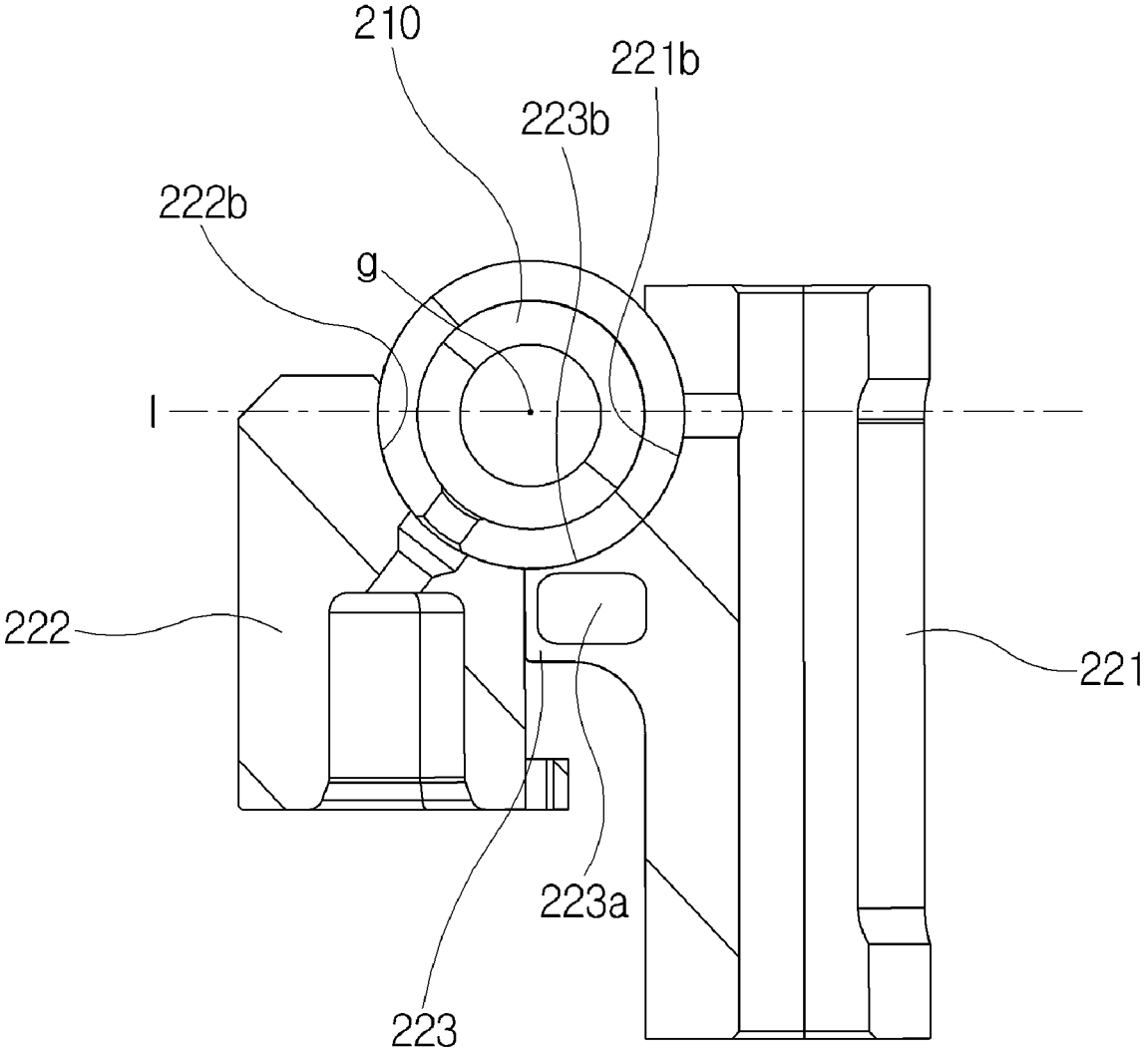
FIG. 12 is a cross-sectional view taken along the line D-D of FIG. 8.

FIG. 8 is a perspective view of a fuel rail to which a mounting structure according to a second exemplary embodiment of the present disclosure is applied, FIG. 9 is a perspective view of the fuel rail of FIG. 8, seen from a different angle, FIG. 10 is a perspective view of the mounting structure of the fuel rail illustrated in FIG. 8, FIG. 11 is a perspective view of the mounting structure of the fuel rail of FIG. 10, seen from a different angle, and FIG. 12 is a cross-sectional view taken along the line D-D of FIG. 8.

Referring to FIGS. 8 to 12, the mounting structure 220 of the fuel rail 200 according to the second exemplary embodiment of the present disclosure may include a mounting boss part 221, an injector cup part 222 and a bridge part 223.

A boss part 20 formed in a cylinder head at an engine, the fuel rail 200, a main pipe 210, the mounting structure 220, the mounting boss part 221, a through-hole 221*a*, a first mating surface 221*b*, a first damping slit 221*c*, an injector cup part 222, a flow path hole 222*a*, a second mating surface 222*b*, the bridge part 223, a second damping slit 223*a* and a third mating surface 223*b* according to the second exemplary embodiment of the present disclosure, correspond to the boss part 10 formed in a cylinder head at an engine, the fuel rail 100, the main pipe 110, the mounting structure 120, the mounting boss part 121, the through-hole 121*a*, the first mating surface 121*b*, the first damping slit 121*c*, the injector cup part 122, the flow path hole 122*a*, the second mating surface 122*b*, the bridge part 123, the second damping slit 123*a* and the third mating surface 123*b* according to the first exemplary embodiment of the present disclosure.

In the second embodiment, the descriptions of the same components as those of the first embodiment are omitted herein in order to more compactly describe the present disclosure.

In the second embodiment, based on the optimal conditions of the first embodiment, a contact center line I may cross the axial center g of the main pipe 210 at a right angle, the contact center line I being formed when the main pipe 210 is clamped by the first mating surface 221*b* of the mounting boss part 221, the second mating surface 222*b* of the injector cup part 222 and the third mating surface 223*b* of the bridge part 223.

This is because, when the structure in which the contact center line I crosses the center axis g of the main pipe at a right angle is adopted, a torsional moment may be effectively prevented even though the main pipe 210 is displaced by heat, pressure and vibration generated from the engine, compared to when a contact center line formed by the first mating surface 121*b* of the mounting boss part 121, the second mating surface 122*b* of the injector cup part 122 and the third mating surface 123*b* of the bridge part 123 in the first exemplary embodiment obliquely crosses the axial center of the main pipe 110 as illustrated in FIGS. 1 to 7.

As described above, the mounting structure of the fuel rail according to the exemplary embodiments of the present disclosure can increase the contact area with the main pipe and effectively distribute stress concentration, thereby improving the fatigue strength. Furthermore, the mounting structure of the fuel rail may have the damping structure which can effectively absorb fatigue stress due to heat, pressure and vibration generated from the engine.

Therefore, when the mounting structure of the fuel rail according to the exemplary embodiments of the present disclosure is applied to a fuel rail for a GDI engine which requires a high internal pressure of 250 bar or more according to environmental regulations, the mounting structure can be utilized as a structure suitable for improving the corresponding performance.

While the present disclosure has been described with respect to the specific embodiments, it will be apparent to those skilled in the art that various changes and modifications may be made without departing from the spirit and scope of the disclosure as defined in the following claims.

The invention claimed is:

1. A mounting structure of a fuel rail, comprising:

a mounting boss part having a through-hole formed in a longitudinal direction thereof, and a first mating surface formed at an outer surface thereof and attached and mated to one side surface of a main pipe;

an injector cup part provided separately from the mounting boss part, and having a second mating surface formed at an outer surface thereof and attached and mated to the other side surface of the main pipe, and a flow path hole formed at one side of the second mating surface and connected to the main pipe so as to transfer fuel to an injector; and a bridge part connecting the mounting boss part and the injector cup part, and having a third mating surface attached and mated to a bottom surface of the main pipe, wherein the bridge part has one or more second damping slits formed at the circumference thereof to absorb fatigue stress due to heat, pressure and vibration generated from the engine, and wherein one of the second damping slits of the bridge part is formed in a hole shape across the bridge part under the third mating surface.

2. The mounting structure of claim 1, wherein the mounting boss part has one or more first damping slits formed at the circumference thereof to absorb fatigue stress due to heat, pressure and vibration generated from the engine.

3. The mounting structure of claim 2, wherein the first damping slit of the mounting boss part is formed in a hole shape connected to the through-hole.

4. The mounting structure of claim 1, wherein the first mating surface of the mounting boss part, the second mating surface of the injector cup part and the third mating surface of the bridge part are configured in such a manner that a contact center line in a direction crossing the main pipe intersects the axial center of the main pipe at a right angle, the contact center line being formed when the main pipe is clamped by the first mating surface of the mounting boss part, the second mating surface of the injector cup part and the third mating surface of the bridge part.

5. The mounting structure of claim 1, wherein the mounting boss part and the bridge part are integrally formed.

6. The mounting structure of claim 5, wherein the bridge part and the injector cup part are coupled to each other by welding or brazing.

* * * * *